US006681455B2

(12) United States Patent
Ichikawa

(10) Patent No.: US 6,681,455 B2
(45) Date of Patent: Jan. 27, 2004

(54) AIRTIGHT WATERPROOF SLIDE FASTENER

(75) Inventor: Nobuhiro Ichikawa, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/167,399

(22) Filed: Jun. 13, 2002

(65) Prior Publication Data

US 2003/0000049 A1 Jan. 2, 2003

(30) Foreign Application Priority Data

Jun. 18, 2001 (JP) ..... 2001-182785

(51) Int. Cl.[7] ..... A44B 19/32
(52) U.S. Cl. ..... 24/389
(58) Field of Search ..... 24/389, 394, 401, 24/403, 409, 410, 411, 412, 413, 585.1, 584.1, 585.11

(56) References Cited

U.S. PATENT DOCUMENTS 2,791,017 A * 5/1957 Mulka ..... 24/38
4,348,789 A * 9/1982 Brown ..... 24/414
4,488,338 A * 12/1984 Takahashi ..... 24/389
4,658,480 A * 4/1987 Morioka et al. ..... 24/389
4,744,133 A * 5/1988 Tsubata et al. ..... 24/389
4,817,252 A * 4/1989 Kusayama ..... 24/389
4,823,446 A * 4/1989 Tsubata et al. ..... 24/389

* cited by examiner

*Primary Examiner*—Robert J. Sandy
(74) *Attorney, Agent, or Firm*—Finnegan, Henderson, Farabow, Garrett and Dunner, L.L.P.

(57) ABSTRACT

An airtight waterproof slide fastener having a pair of fastener stringers in which a side edge of an airtight waterproof tape is bent so as to wrap and hold plurality of coupling elements having a coupling heads from a flange side thereof so as to form an engagement tooth holding portion having a substantially Ω-shaped cross section and a peripheral face of that engagement tooth holding portion is nipped and fixed by means of a substantially U-shaped clamp element having of a pair of sheet-like nipping pieces. The clamp element is provided with stress-releasing portions between clamp elements for releasing tensile stress generated in a tape portion existing between side faces of the adjacent nipping pieces when the airtight waterproof tape is bent between the adjacent clamp elements, so as to secure air-tightness and not to be broken easily even if it is bent strongly in its longitudinal direction.

7 Claims, 8 Drawing Sheets

AIRTIGHT WATERPROOF SLIDE FASTENER

BACKGROUND OF THE INVENTION

1. Field of the Invention

The present invention relates to airtight waterproof slide fastener, which is employed at a portion demanding airtight waterproof performance under high pressures such as in diving suits and underwater tunnels.

2. Description of the Related Art

Engagement teeth for the airtight waterproof slide fastener provided currently are largely divided into two types of structures, which are an engagement tooth structure disclosed in, for example, Germany Patent No. 856881, Japanese Utility Model Application Laid-Open No. 58-181210, and Japanese Patent Application Publication No. 63-8763, and an engagement tooth structure disclosed in, for example, Japanese Patent Application Publication No. 1-54041, Japanese Patent Application Publication No. 2-16648, and Japanese Utility Model Application Publication No. 5-2098. Composing elements of these engagement teeth include a spear-shaped coupling element having a coupling head at its front end and a substantially U-shaped clamp element having a nipping portion composed of a pair of small sheet pieces and a connecting portion for connecting end portions thereof. This clamp element is usually obtained by fastening a rectangular sheet piece into a substantially U-letter shape.

According to the engagement tooth structure disclosed in the above-mentioned Germany Patent No. 856881, Japanese Utility Model Application Publication No. 58-181210, and Japanese Patent Application Publication No. 63-8763, the coupling element is so constructed as to be directed from the center of the inside of the connecting portion of the clamp element such that the coupling head is exposed out and protruded integrally therewith. In order to fix this engagement teeth to the airtight waterproof fastener tape, insertion holes for the coupling heads are formed at a predetermined pitch along a side edge of this airtight waterproof tape and the coupling head of the engagement tooth is passed through this hole. Then, the airtight waterproof tape is bent and pushed in the shape of Ω such that the insertion hole forming portion makes a firm contact with a curved bottom of the clamp element and then, the clamp element is fastened from both front and rear sides so as to nip the tape firmly in order to produce the airtight waterproof fastener stringer.

On the other hand, according to the structure of the engagement tooth disclosed in the Japanese Patent Application Publication No. 1-54041, Japanese Patent Application Publication No. 2-16648, and Japanese Utility Model Application Publication No. 5-2098, a coupling element comprising a coupling head at a front end thereof and an spear-shaped coupling element having a rectangular flange at the rear end thereof, and a substantially U-shaped clamp element are formed separately. To fix the engagement tooth onto the airtight waterproof tape, a side edge portion of the airtight waterproof tape is wound around from the flange side to the coupling head at the front end such that it wraps and holds the coupling element. Then, the clamp element is held through the airtight waterproof tape from the flange side of the coupling element up to just before the coupling head and fastened strongly so that the tape wraps and holds the clamp element. Consequently, the side edge portion of the airtight waterproof tape is bent in the shape of Ω by means of the clamp element, so that the tape is nipped and fixed firmly, thereby an airtight waterproof fastener stringer is produced.

Air-tightness and waterproofness of these airtight waterproof slide fasteners is warranted by contact pressing force of the airtight waterproof tape portion which is bent and exposed outward between the coupling head of each of a pair of opposing fastener stringers and the clamp element. If this contact pressing force is weak, gap is generated between the tapes pressing each other, by hydraulic pressure or other external forces applied to the airtight waterproof tape.

By the way, in the above-described engagement tooth comprising integrated coupling element and clamp element, management of parts is facilitated because the number of required parts is reduced. However, to fix the engagement tooth to the airtight waterproof tape, insertion holes for the coupling heads need to be formed in the side edge portion of the airtight waterproof tape. Further, after inserting the coupling head into the insertion hole, it is necessary to push the tape toward the bottom face of the clamp element so that it is bent in the shape of letter U. Consequently, this fixing structure allows the airtight waterproof tape to move easily in the width direction of the tape, so that the nipping and fixing force by the clamp element tends to weaken. Thus, as described in Japanese Utility Model Application Laid-Open No. 58-181210, a lip for nipping the tape is projected from opposing faces at open side end portions of the clamp element so as to increase the fixing strength of the engagement tooth to the airtight waterproof tape.

For the airtight waterproof slide fastener of this type, securing its airtight waterproof performance depends upon contact pressing force between opposing tape portions when opposing engagement teeth of a pair of fastener stringers are coupled. Then, if a tongue piece is formed such that it is projected outward at right angle from one end or both ends of front and rear sides of the clamp element bent in a substantially U shape so as to increase the contact area, necessary contact pressing force is secured such that necessary airtight waterproof performance is easily obtained. However, formation of the tongue piece such that it is projected outward of the clamp element increases the thickness of the entire slider, which is a fastener opening/closing device, in a direction perpendicular to the airtight waterproof tape.

On the other hand, in the structure of the engagement tooth comprising a coupling element and a clamp element formed separately as indicated by the above Japanese Patent Application Publication No. 1-54041, Japanese Patent Application Publication No. 2-16648 and Japanese Utility Model Application Publication No. 5-2098, fixing work to the airtight waterproof tape is easy although the number of parts increases. Further, because fixing strength to the airtight waterproof tape is intensified by existence of a flange formed at the proximal end portion of the coupling element, this is a preferable engagement tooth structure from the viewpoint of practicability.

In any one of the above-mentioned engagement tooth structures, almost all conventional clamp elements have substantially rectangular shapes and opposing side faces in adjacent nipping portions of the clamp element are parallel to each other. Its exception is the above-mentioned Germany Patent No.856881. According to this specification, each clamp element fixed to a side edge of a pair of the fastener stringers in zigzag shape is formed in the shape of a trapezoid, whose width is decreased gradually toward a front end of the nipping portion when seen in side view.

Because the front end faces of the nipping portions of the clamp element disposed such that they oppose each other are disposed being shifted completely in the tape direction, they do not have any overlapping opposing faces. Thus, necessary contact pressing force between the waterproof tapes is not generated and airtight waterproof performance is reduced because no direct pressure force is applied to the airtight waterproof tape by the respective front end faces of the opposing nipping portions of the clamp element.

In the meantime, in the airtight waterproof slide fastener of this type, products with this fastener such as a diving suit may be folded or left without being tidied up, and be trod when they are not used. At this moment, the fastener stringer of the airtight waterproof slide fastener is folded between the engagement teeth at the same time. FIG. 7 shows a folding condition of a fastener stringer 108 at this moment. FIG. 7A is a front view of the same fastener stringer 108, while FIG. 7B is a plan view of major parts of the same fastener stringer 108 when seen from a folded side i.e., an inner side of the folded stringer.

Because the nipping portion of an ordinary clamp element provides a rectangular shape when seen in side view thereof as described above, the outside ridgelines of opposing nipping pieces 105*a* in the clamp elements 104 adjacent to each other on the folded side make a firm contact while the outside ridgelines of nipping pieces 105*b* on an opposite side across an airtight waterproof tape 101 of the clamp element 104 are about to open largely in the longitudinal direction of the tape with respect to the contact portion between the outside ridgelines on the folded side of the nipping pieces 105*a*.

That is, because of the turning around an outside ridgeline of the nipping portion 105 in the clamp element 104, compression stress is applied to the airtight waterproof tape portion on a side in which the outside ridgelines make a firm contact while a strong tensile stress is applied to an airtight waterproof portion located between the outside ridgelines on the opposite side across the same tape 101 at the same time. Consequently, the airtight waterproof tape portion on the side in which the tensile stress is applied is torn out easily. This rapture of the airtight waterproof tape 101 loses the airtight waterproof performance, which should be a primary function of the airtight waterproof slide fastener 100.

The present invention has been achieved to solve the above-described problem and a concrete objective of the invention is to provide an airtight waterproof slide fastener of this kind capable of securing air-tightness and which is not broken easily even if it is bent strongly in the longitudinal direction.

SUMMARY OF THE INVENTION

The inventors have repeated discussions and experiments from various aspects in order to achieve the above objective. As a result, they recognized that it is effective to employ the structure as follows.

According to its basic structure, there is provided an airtight waterproof slide fastener having a pair of fastener stringers in which a side edge of an airtight waterproof tape wraps and holds plurality of coupling elements from flange sides, makes their coupling heads project outward, and is folded so as to form an engagement tooth holding portion having a substantially Ω-shaped cross section on the side edge of the tape and a peripheral face of this engagement tooth holding portion is nipped and fixed with a substantially U-shaped clamp element constituted of a nipping portion comprised of a pair of sheet-like nipping pieces and a connecting portion for connecting ends of respective nipping pieces, wherein the clamp element comprises a stress-releasing portion for releasing tensile stress generated in a tape portion existing between side faces of adjacent nipping pieces when the airtight waterproof tape is folded between adjacent clamp elements.

When the tape face of the airtight waterproof slide fastener of this kind having a conventional ordinary structure is folded in the longitudinal direction of the airtight waterproof tape, the outside ridgelines of opposing nipping pieces of adjacent clamp elements on the folded side make a firm contact and the clamp element is turned around the contact portion of the outside ridgelines, so that the same tape is opened largely between the outside ridgelines opposite to the folded side of the airtight waterproof tape. At this time, the contact portion of each outside ridgeline making a firm contact is locked and not moved relatively, so that the center of turning is fixed. Consequently, the folded airtight waterproof tape receives a large tensile stress in the longitudinal direction on an opposite side to the folded side between both clamp elements, so that it is broken out.

Thus, according to the present invention, a stress-releasing portion is formed to release excessive tensile stress generated partly in a tape portion located between the nipping portions on the front and rear face sides of the clamp element, which wraps and holds the airtight waterproof tape substantially in a C-shape. Consequently, when the airtight waterproof slide fastener is folded as described above, the firm contact position between the ridgeline portions is allowed to be moved relatively because of existence of the stress-releasing portion, so as to release excessive tensile stress between the nipping pieces at the opposite side of the folded side. As a result, no excessive tensile stress is generated in the ridgeline opposite to the folded side, so that a rapture of the airtight waterproof tape at that position is avoided effectively.

Further, according to the present invention, it is preferable that front end faces opposing each other of the nipping portions disposed such that they oppose in a zigzag shape at a predetermined pitch along opposing edge portions of a pair of the fastener stringers when the engagement teeth are coupled, are partly overlapped.

Generally, the clamp element has lip portions, which are formed on opposing end faces on front and rear nipping pieces such that they are projected so as to approach each other. When the engagement tooth portion of the airtight waterproof tape bent substantially in a Ω shape is nipped strongly by means of the front and rear nipping pieces by fastening the clamp element, the lip portions provided inward protrudedly at the front ends of the nipping pieces bite into the engagement tooth holding portion so as to enhance the fixing thereof.

According to experiments by the inventors of the present invention, when the front face of the lip portion is formed in an appropriate size, even if a tongue projected to an opposite side to the lip portion is not formed at a front end of the nipping portion, necessary contact pressing force can be applied to bent portions of the airtight waterproof tapes, said bent portions being exposed outward and opposing each other, by means of pressure forces by front faces of the lip portions which generate when the airtight waterproof slide fastener is fastened. Consequently, it was proved that a sufficient air-tightness is secured.

On the other hand, the clamp element is fixed to each fastener stringer so that the front faces of the lip portions are disposed so as to oppose each other in a zigzag shape at a predetermined pitch along the opposing edge portions of a pair of the fastener stringers, when the engagement teeth are coupled. However, as described in the Germany Patent No.

856881, if the opposing faces of the clamp elements are shifted in the longitudinal direction of the tape, so that there is no overlapping portion to which the pressure force should be directly applied, no sufficient contact pressing force is generated on exposed opposing edges between the airtight waterproof tapes of a pair of the fastener stringers. Thus, according to the present invention, the opposing faces of the clamp elements, which are arranged so as to oppose each other in a zigzag shape, are disposed so as to partly overlap each other always. In this way, necessary contact pressing force between the airtight waterproof tapes are ensured and thereby airtight waterproof performance of the airtight waterproof slide fastener is enhanced.

Further, according to the present invention, it is preferable that the stress-releasing portion includes a tapered face in which, in plan view of the clamp element, the width of the side face of the nipping portion is decreased gradually at a predetermined angle in a direction from an end face on the connecting portion side of the clamp element toward a front end of the nipping portion with a start position, which is on a front end side from a position whose distance from the end face on the connecting portion is determined by summing up the thickness of the clamp element and the thickness of the airtight waterproof tape.

If the tape face of the airtight waterproof tape of the airtight waterproof slide fastener is folded in a longitudinal direction, the outside ridgelines on the nipping pieces on the folded side of the adjacent nipping portions located at a portion to be folded make a firm contact with each other as described above, so that the nipping portion is turned with that contact portion as a fulcrum point. Consequently, a large tensile stress is generated at the airtight waterproof tape located opposite to the folded side and between the adjacent clamp elements. If the nipping portion of the clamp element is rectangular in plan view as a conventional clamp element is, when the airtight waterproof slide fastener is folded as described above, the front end of the nipping portion of the clamp element is located on a tape main body side of the overlapping airtight waterproof tape, while the connecting portion side of the clamp element is located at a free end side of the airtight waterproof tape. Therefore, the folding configuration in the longitudinal direction of the tape is similar to a part of a substantially cylindrical shape in which the connecting portion side is stretched while the front end side of the nipping portion is compressed.

As a result, the clamp elements make a firm contact at the outside ridgeline portions on the front end side of the adjacent nipping portions with the folding portion of the airtight waterproof slide fastener as the center, the side faces on the connecting portion side are slightly open. In this situation, little internal stress is generated inside the folded portion of the engagement tooth holding portion in the airtight waterproof tape folded at the base portion side of the coupling element, while an excessive tensile stress is generated so as to stretch the outside of the folded portion largely.

The present invention is achieved with focus on the above-described folding configuration. At first, it was considered that the stress-releasing portion could be made by providing right and left side faces of the nipping portion of each clamp element each with a tapered face whose front end side becomes narrower gradually like the above-described substantial cylindrical shape. However, according to the fixing structure of the engagement tooth to the airtight waterproof tape of the present invention, as mentioned above, the clamp element is bent and fixed to the airtight waterproof tape so that the airtight waterproof tape and the clamp element wrap and hold the coupling element.

To nip the airtight waterproof tape strongly with the entire nipping portions of the clamp element with such a fixing structure, it is preferable to ensure at least the same nipping force at a border face between the nipping portion and the connecting portion as that of conventional ones. For this purpose, as in the present invention, at least the airtight waterproof tape's engagement tooth holding portion bent substantially in a C-shape and the border face from the connecting portion of the clamp element up to the nipping portion need to have a similar width in the longitudinal direction of the tape to that of conventional ones. Thus, in the present invention, the start point of the tapered face, whose width is reduced gradually toward the front end of the nipping portion, is set up at a position determined by summing up the thickness of the clamp element and the tape thickness of the airtight waterproof tape.

According to the present invention having the above-mentioned structure, a fixing strength necessary for the engagement tooth to fix the airtight waterproof slide fastener is secured, and when the airtight waterproof slide fastener is folded in a longitudinal direction, the tapered face serves as a stress-releasing portion, so as to avoid an interference to each other. Even if the outside ridgeline portions make a contact, they are just only in a slight contact when the folding is completed. Thus, no excessive tensile stress is generated in an airtight waterproof tape portion existing between a nipping portion opposite to the folded side and the connecting portion, so that rapture in the airtight waterproof tape portion can be avoided.

Preferably, the tapered angle of the tapered face on both side faces of the clamp element is 3° to 7° as in the present invention. If the tapered angle is less than 3°, the outside ridgeline portions of the adjacent nipping pieces on the folded side make a firm contact with each other so that they are locked. Consequently, the function as the stress-releasing portion is not exerted sufficiently, so that rapture is easily generated in the airtight waterproof tape between the clamp elements on a folding side i.e., an outer side of the folded stringer. Meanwhile, if the tapered angle exceeds 7°, a direct pressure force, which is applied to between the clamp elements disposed such that they oppose each other, is unlikely to be generated when the airtight waterproof slide fastener is fastened. Thus, the contact pressing force between the opposing airtight waterproof tapes is not generated effectively, and obtaining necessary air-tightness performance becomes difficult.

Further, it is preferable that the stress-releasing portion includes chamfered portions on the peripheral face of the front end-side corner portion of the nipping portion. In addition, it is preferable that the stress-releasing portion includes a chamfered portion formed on outside ridgeline portions of the nipping portion. Moreover, the stress-releasing portion including a chamfered portion formed at least on an end portion of the inside ridge line portion of the nipping portion is formed in some cases.

Any of these stress-releasing portions can avoid effectively rupture of a part of the airtight waterproof tape between the clamp elements around the folded portion when the airtight waterproof slide fastener is bent in a longitudinal direction.

DESCRIPTION OF THE PREFERRED EMBODIMENTS

Figure 1:
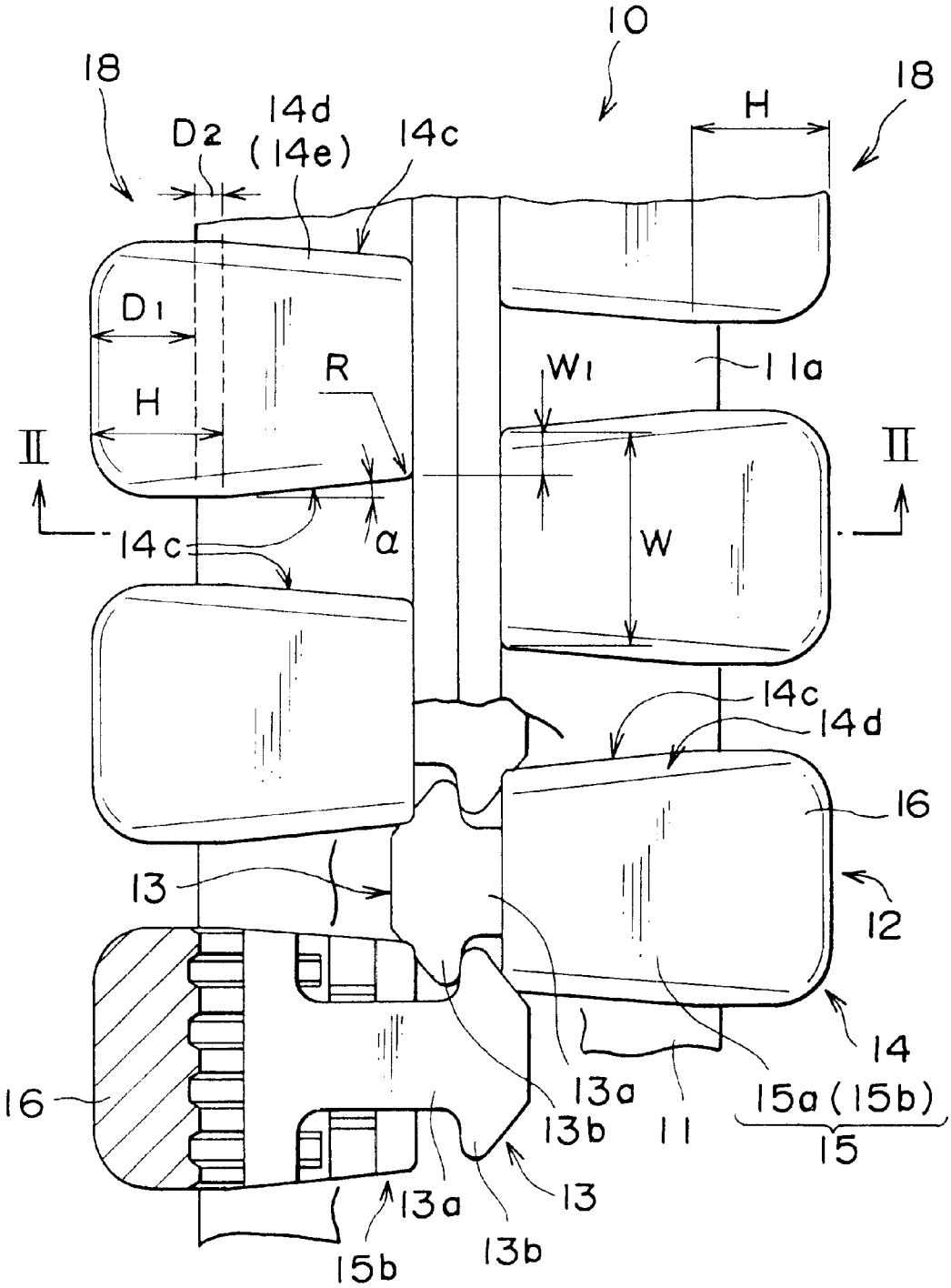
FIG. 1 is a plan view of enlarged major portions, with the coupling portions of the engaging airtight waterproof slide fastener according to a typical embodiment of the present invention, with the coupling portion partly broken out.

Hereinafter, preferred embodiments of the present invention will be described concretely with reference to the drawings.

The airtight waterproof slide fastener 10 of this embodiment comprises, as conventionally, an airtight waterproof tape 11, engagement teeth 12, a slider (not shown), upper/bottom stop ends (not shown) and so on. The airtight waterproof tape 11 consists of rubber material or soft synthetic resin sheet alone or water tight material such as a fabric coated with rubber or elastomer resin. A side edge portion of that tape 11 is bent along the longitudinal direction and the engagement teeth 12 are fixed at a predetermined interval along the side edge portion.

According to this embodiment, the engagement tooth 12 comprises a coupling element 13 and a clamp element 14 which consist of different members. In the meantime, the present invention also includes a case where the coupling element 13 and the clamp element 14 are formed integrally. If the coupling element 13 and the clamp element 14 are constructed separately, part of the shape of the coupling element 13 is different, as mentioned above, from a case where the coupling element 13 and the clamp element 14 are formed integrally.

The entire configuration of the said coupling element 13 formed separately in this embodiment is not different from conventional examples, and includes a spear-shaped coupling head 13*b*, which has a rectangular cross section at a front end of a rectangular column portion 13*a*, and a rectangular flange 13*c* at a proximal end of the rectangular column portion 13*a*. In the coupling element 13 having such a configuration, as shown in FIG. 2, a side edge portion of the airtight waterproof tape 11 is bent so as to wrap and hold the flange 13*c* of the coupling element 13 and further, a tape main body side and a tape side-edge side are bent so that they are opened widely so as to form an engagement tooth holding portion 11*a*, in which cross section of the entire bent part is substantially in the shape of Ω, so that the coupling head 13*b* can be exposed outside of the engagement tooth holding portion 11*a*.

Figure 2:
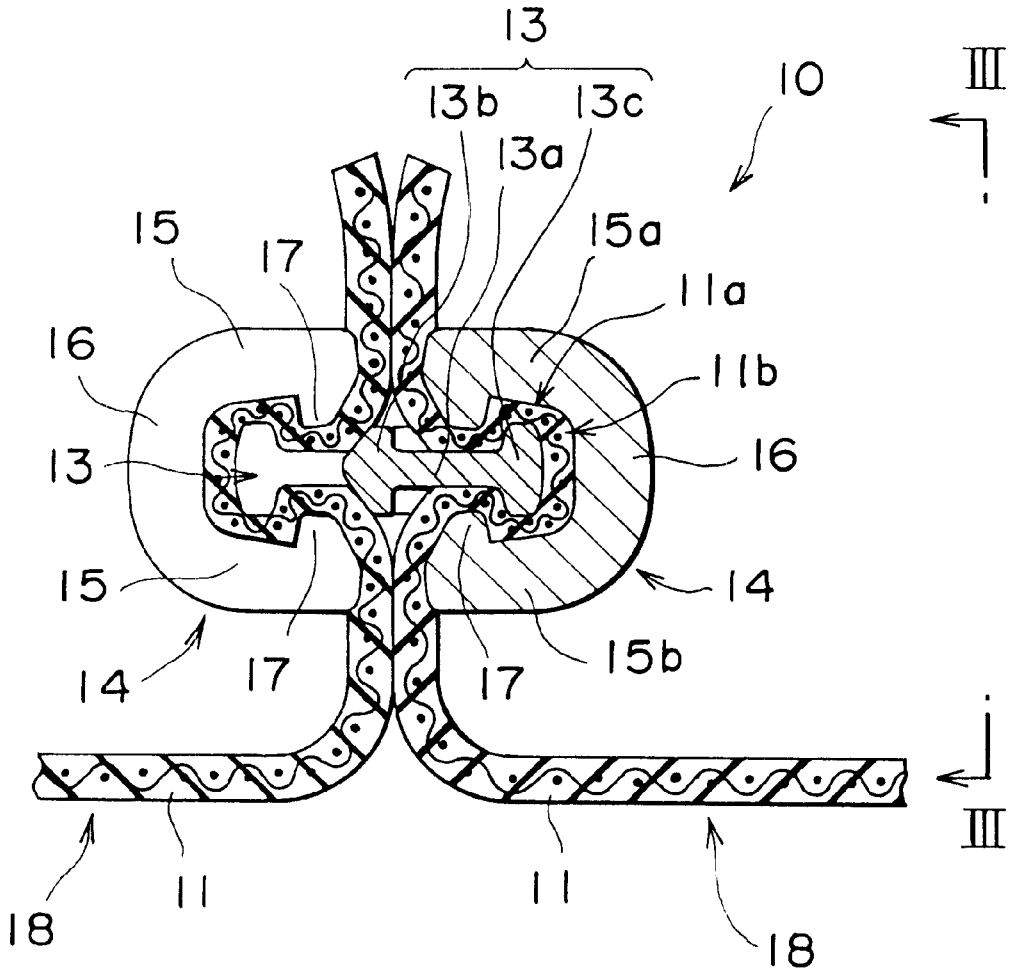
FIG. 2 is a sectional view taken along the line II—II of FIG. 1.
Figure 3:
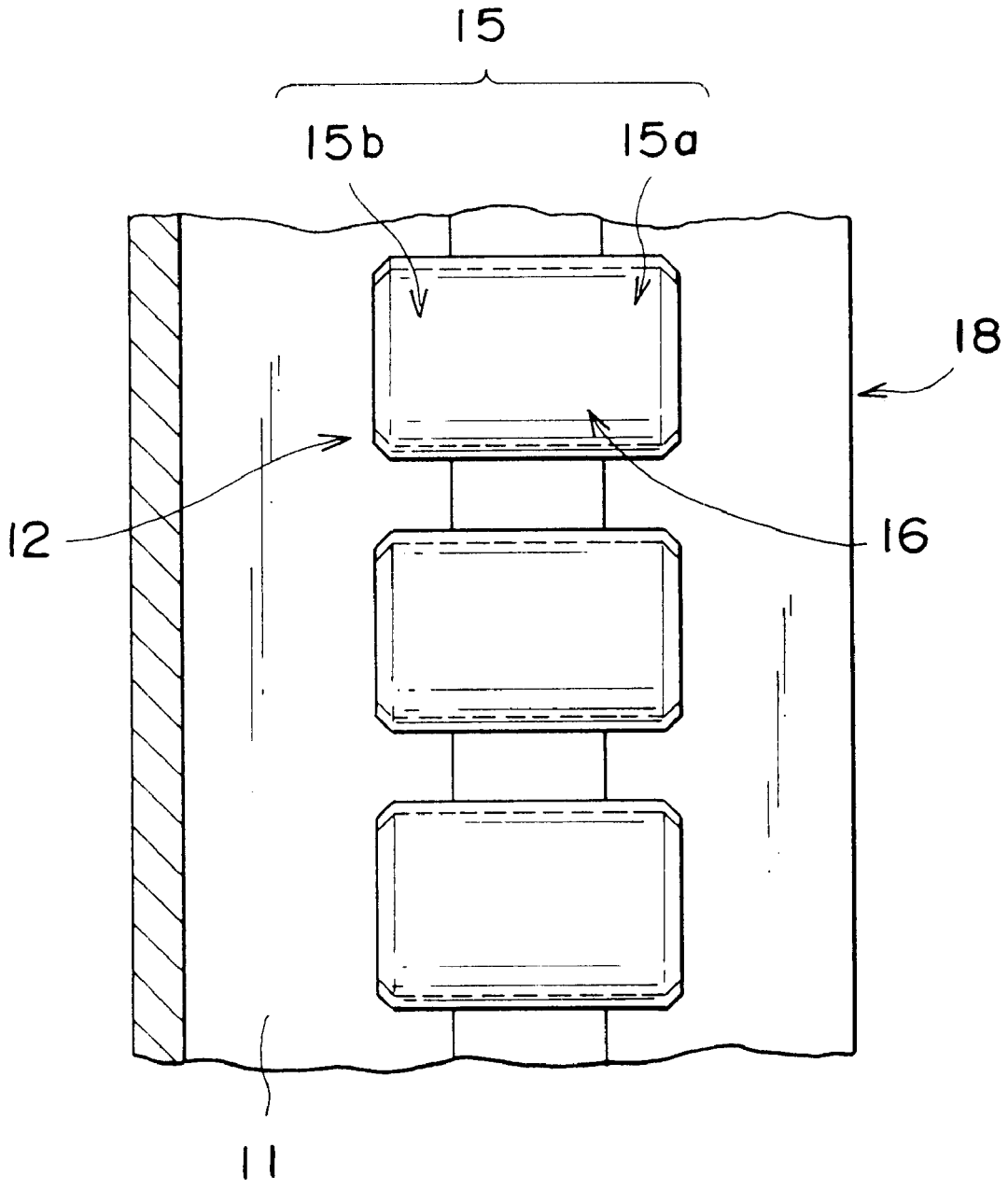
FIG. 3 is a sectional view taken along the line III—III of FIG. 2.
Figure 4:
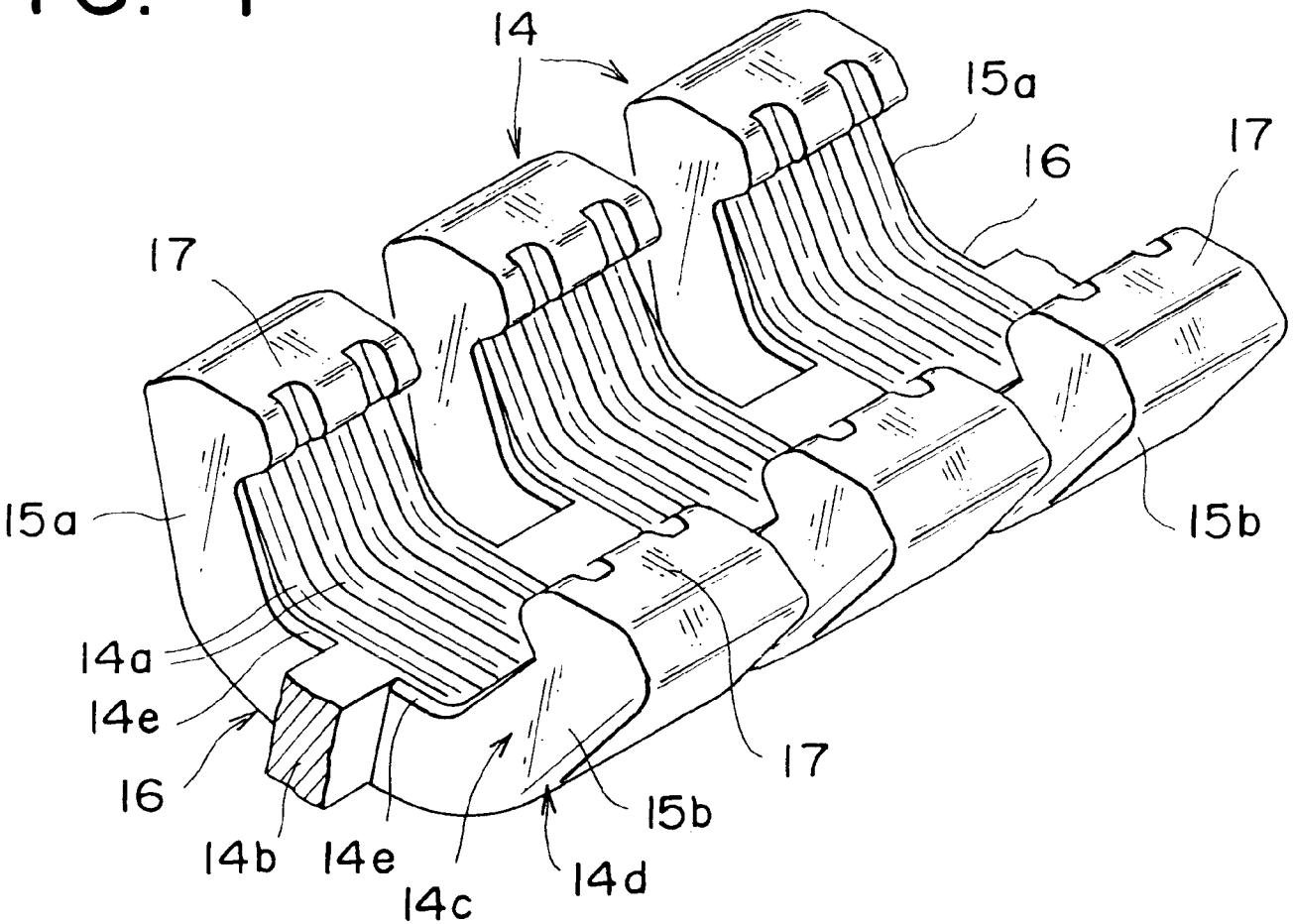
FIG. 4 is a perspective view seen from inside indicating an example of a structure of a clamp element row before fixed which is applied to the present invention.
Figure 5A:
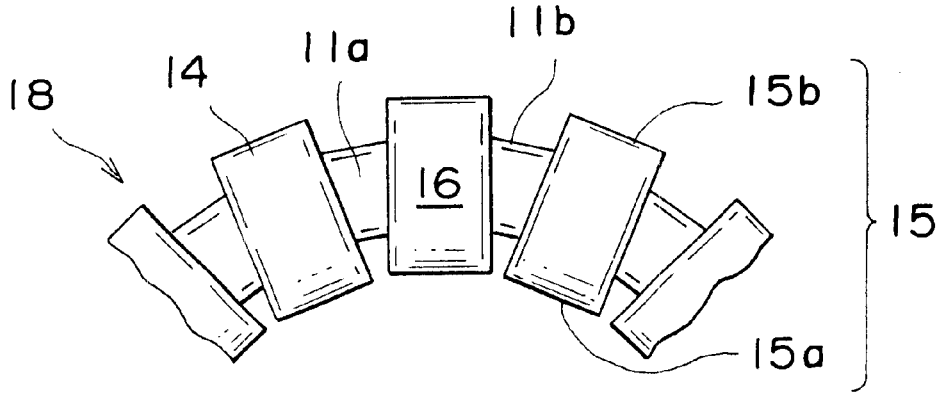
FIGS. 5A and 5B are explanatory diagrams showing the folding condition of the airtight waterproof slide fastener of the present invention.
Figure 5B:
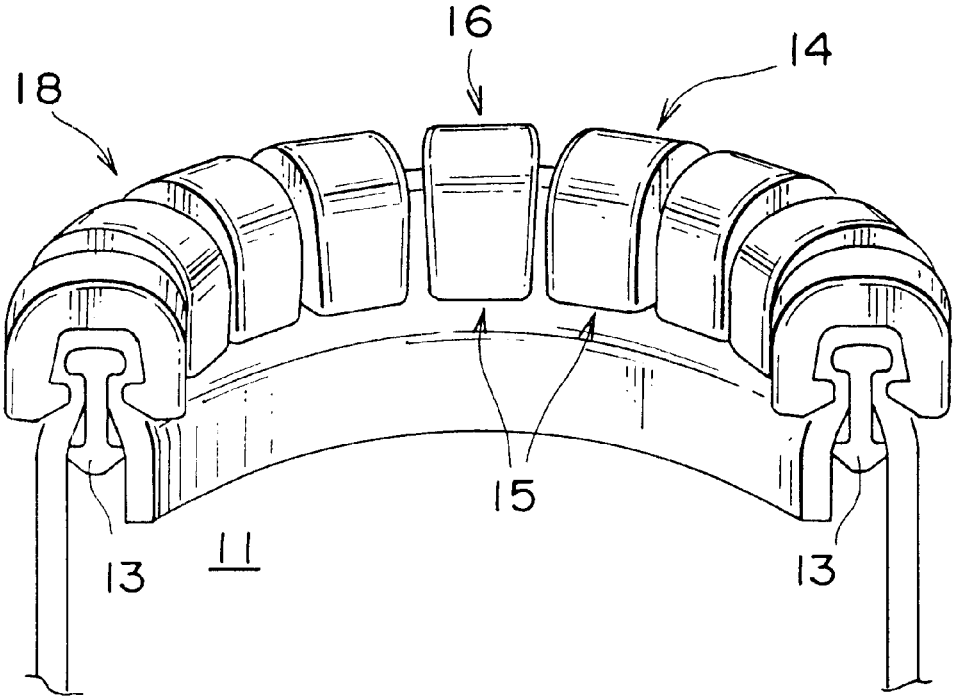

As shown in FIG. 2, the clamp element 14 is bent and deformed with force along the peripheral face of the engagement tooth holding portion 11*a* of the airtight waterproof tape 11, which is bent so as to wrap and hold the flange 13*c* and the rectangular column portion 13*a* of the coupling element, so that plurality of the engagement teeth 12 are fixed at a predetermined interval on the side edge portion of the airtight waterproof tape 11. In order to arrange plurality of the coupling elements 13 in a line and wrap and hold these coupling elements 13 with the side edge portion of the airtight waterproof tape 11, plurality of the coupling elements 13 are arranged successively at a predetermined interval along the side edge portion of the airtight waterproof tape 11 before the coupling elements 13 are wrapped and held with the side edge portion of the airtight waterproof tape 11. On the other hand, the clamp element 14, which is bent substantially in a U-shape as described above, is constituted of a bent sheet piece in which, as shown in FIG. 4, a pair of sheet-like nipping pieces 15*a*, 15*b* inclined such that an interval between one ends thereof is wider than that between the other ends are connected by a connecting portion 16 at the said other ends of the nipping pieces 15*a*, 15*b*.

Lip portions 17 are formed at respective end portions opposite to connecting portion 16 sides of respective nipping piece 15*a*, 15*b*, such that the lip portions 17 are protruded in a direction opposed to each other. Meanwhile, concave grooves 14*a* are formed in a bending inner face of the clamp element 14 including the lip portion 17 such that they are extended linearly in the bending direction. The central side faces of the connecting portions 16 of the adjacent clamp elements 14 are connected integrally by a connecting lever 14*b*. After the clamp elements 14 are bent and deformed further so as to be mounted on the airtight waterproof tape 11, the connecting lever 14*b* is cut out, the engagement teeth 12 are fixed integrally on the side edge portion of the airtight waterproof tape 11, and a fastener stringer 18 is produced thereby.

A slider (not shown) is mounted on a pair of the fastener stringers 18 having a predetermined length, and an upper stop end (not shown) is fixed on an end of the stringer 18 while a bottom stop end (not shown) is fixed on the other end. The airtight waterproof slide fastener 10 is produced thereby. FIG. 2 shows a sectional view when the airtight waterproof slide fastener 10 is closed with the slider.

Figure 6:
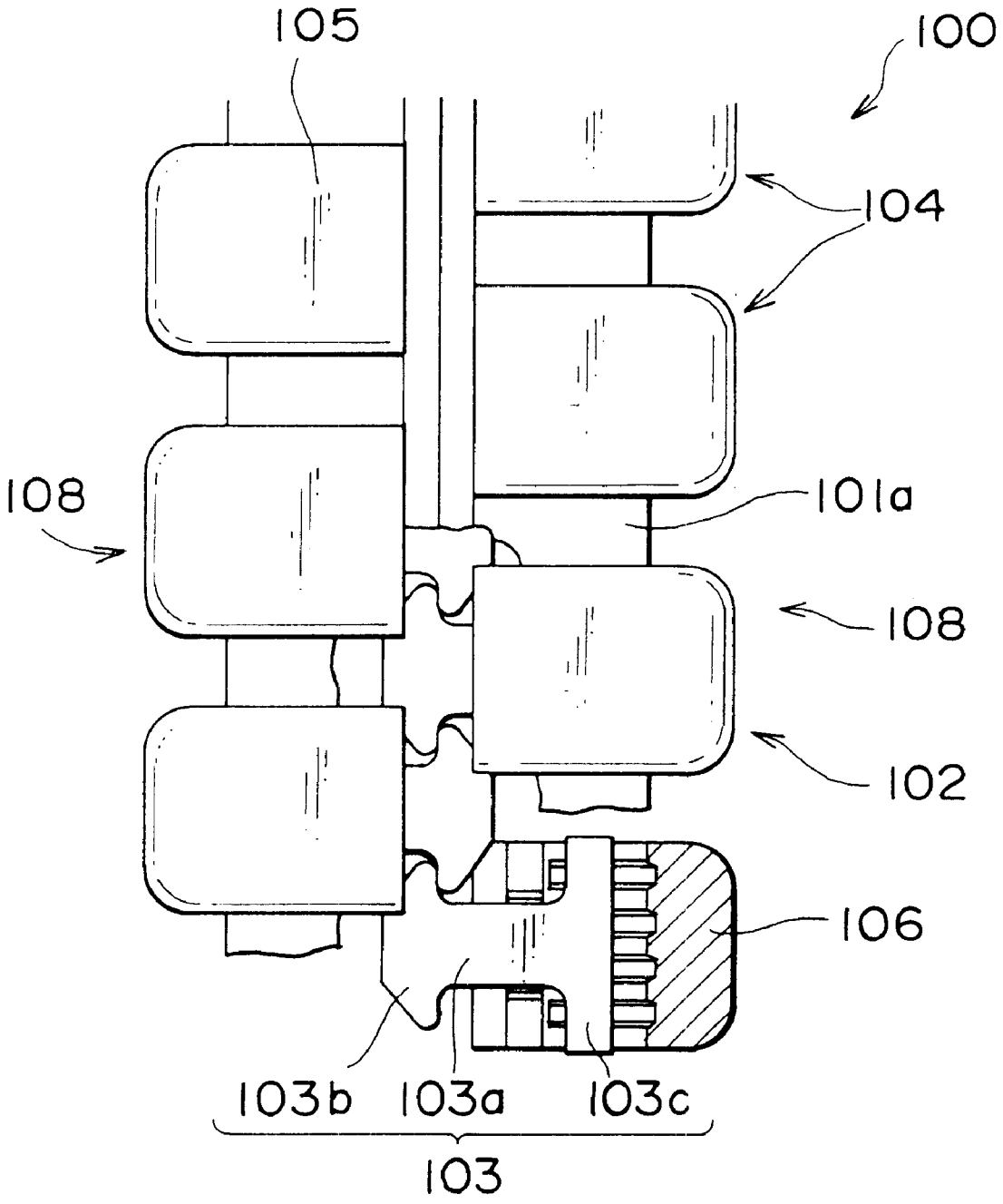
FIG. 6 PRIOR ART
FIG. 6 is a plan view of major portions of the airtight waterproof slide fastener, showing a conventional engagement tooth fixing portion broken out.

The structure of the fastener described above is substantially the same as conventional fasteners except for the structure of the clamp element 14. The conventional clamp element 104 has a substantially rectangular shape in its plan view as described with reference to FIGS. 6 and 7. In contrast, in the clamp element 14 of this embodiment, a stress-releasing portion for an excessive tensile stress, which is generated in the tape portion 11*b* of the engagement tooth holding portion 11*a* located between the adjacent clamp elements 14 when the airtight waterproof slide fastener 10 is bent, is formed in the nipping portion 15 of the clamp element 14, which is a distinguished feature of the present invention.

Figure 7A:
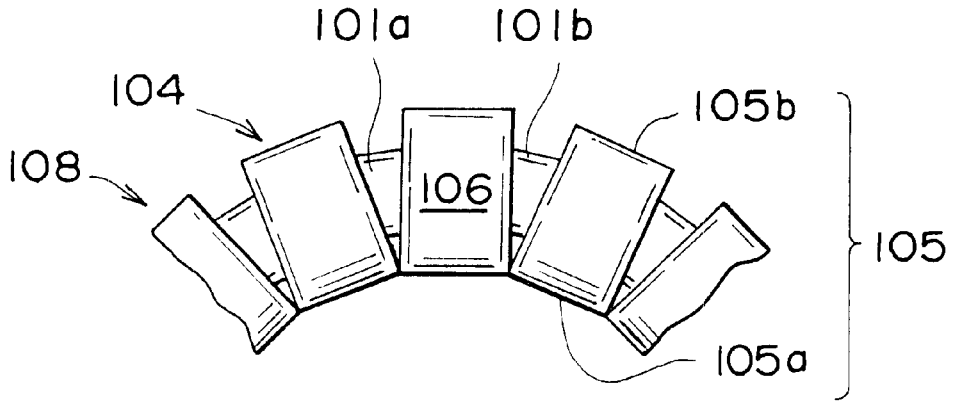
FIG. 7A PRIOR ART
FIGS. 7A and 7B are explanatory diagrams showing the folding condition of the conventional airtight waterproof slide fastener.

This will be described with reference to FIGS. 1 to 4 showing the structure of the clamp element 14 of this embodiment and FIG. 7 showing the structure of the conventional clamp element 104.

First, the structure of the conventional clamp element 104 is described briefly with reference to FIG. 7. The entire configuration of the clamp element 104 is substantially the same as that of the clamp element 14 of this embodiment. However, in the conventional clamp element 104, nipping pieces 105*a* and 105*b* of the nipping portion 105 are composed of substantially-rectangular small pieces and the width in the longitudinal direction of the tape thereof is the same throughout an entire region of the nipping portion 105. Moreover, no special processing is applied to ridgeline portions of outside and inside faces of the respective nipping pieces 105*a* and 105*b* and each ridgeline portion are angled substantially at 90°.

Figure 7B:
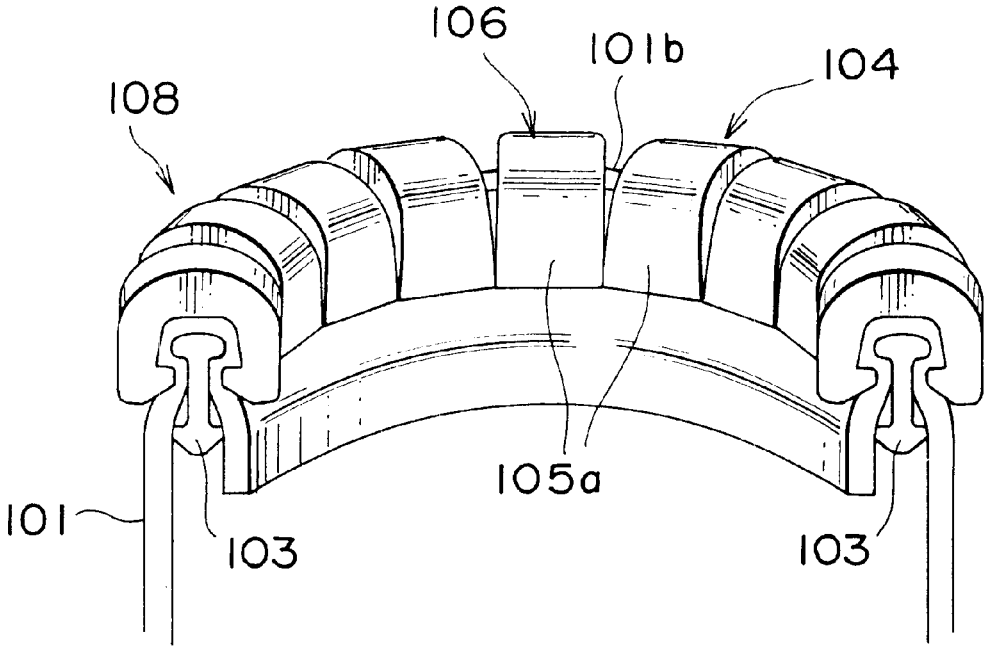
FIG. 7B PRIOR ART

Therefore, when the conventional fastener stringer 108 is bent in its longitudinal direction along its tape surface, in a plan view shown in FIG. 7(B), the ridgeline portions on front end sides of the bent nipping pieces 105*a* are fit to each other between the engagement tooth 102 at a bending center and its adjacent engagement tooth 102, and the engagement teeth tend to separate from each other at the connection portion 106 sides. Consequently, tensile stress is generated in the tape portion on the connecting portion 106 sides of said adjacent clamp elements 104. At this moment, the adjacent clamp element 104 is, as shown in FIG. 7B, moved around the aforementioned portion, in which the nipping pieces 105*a* on a bent side are fit to each other, so that a force is applied to move the nipping piece 105*b* opposite to the bent side in such a direction that they separate from each other. Moreover, a tensile stress is generated in a tape portion on a connecting portion 106 side, when seen in plan view. Consequently, an extremely high tensile stress is generated in a tape portion of the engagement tooth holding portion 101*a* located between the nipping piece 105*b*, particularly in the tape portion 101*b* on the connecting portion 106 side. As a consequence, the tape portion 101*b* begins to be broken by the nipping piece 105*b* from a nipping end portion.

On the contrary, in the configuration of the clamp element 14 of this embodiment, as shown in FIGS. 1 and 4, various stress-releasing portions are formed in parts of each nipping piece 15*a* and 15*b*. This prevents the tape portion 11*b* on the connecting portion 16 side in the engagement tooth holding portion 11*a* from being broken easily.

As shown in FIGS. 1 and 4, said stress-releasing portion of this embodiment includes a tapered face 14*c* formed on each of the right and left side faces of the nipping pieces 15*a* and 15*b* and chamfered portions 14*d* and 14*e* formed on inside and outside the ridgeline portions. Further, as shown by a symbol R in FIG. 1, the corner portion at the front end of each nipping piece 15*a*, 15*b*, particularly an inside corner portion thereof, is chamfered and formed in a small arc face as a chamfered portion. Although this embodiment allows far various stress-releasing portions to be formed, not all these stress-releasing portions are necessary in some cases and therefore, a part of them may be cancelled.

Upon designing the tapered face 14*c*, which is the most effective means as the stress-releasing portion for the tensile stress, there are points to which more attention should be paid than those upon designing of the other stress-releasing portions. These points will be described concretely together with their functions with reference to FIGS. 1 and 4 and Table 1.

A first point to which attention should be paid is the formation start point of the tapered face 14*c* which is to be formed on the nipping portion 15. Generally, the size and arrangement pitch of the clamp element 14 are determined preliminarily depending upon the dimension (width, length and the like) and application purpose of the airtight waterproof slide fastener 10, the structure of the tape, or material. If the tapered face 14*c* is formed from the outside edge of the connecting portion 16 up to a front end of the nipping portion 15 so that the tapered face is substantially trapezoidal in plan view of the clamp element, nipping force on the airtight waterproof tape 11 by the clamp element 14 decreases.

Thus, according to this embodiment, as for the formation start point of the tapered face 14*c*, a substantial nipping area for the airtight waterproof tape 11 is secured on the connecting portion 16 side so as to ensure a necessary nipping force on the airtight waterproof tape 11 by the clamp element 14. That is, the formation start point of the tapered face 14*c* is set up at a dimensional position H, whose distance from an outside end face of the connecting portion 16 is at least D1+D2 or more, wherein D1 is the thickness of the clamp element 14 and D2 is the thickness of the airtight waterproof tape 11. If the formation start point of the tapered face 14*c* is set up on the connecting portion 16 side with respect to this dimensional position H, the engagement teeth 12 are more likely to be disengaged because of a lateral pulling force of the airtight waterproof slide fastener 10.

A next point to which attention should be paid is a tapered angle a of the tapered face 14*c*. As described above, if this tapered angle $\alpha$ is too small, the airtight waterproof tape 11 is more likely to be partly broken out when the airtight waterproof slide fastener 10 is folded. If the tapered angle $\alpha$ is too large, the width dimensions W of the front ends of nipping pieces 15*a*, 15*b* of the clamp elements 14 becomes small, so that an overlapping portion W1 between front end faces of the nipping pieces 15*a*, 15*b* of opposing clamp elements 14 of a pair of fastener stringers 18 is eliminated. Consequently, contact pressing force which is generated between the opposing airtight waterproof tapes 11 is decreased, so that a required airtight waterproof performance cannot be obtained.

Figure 8:
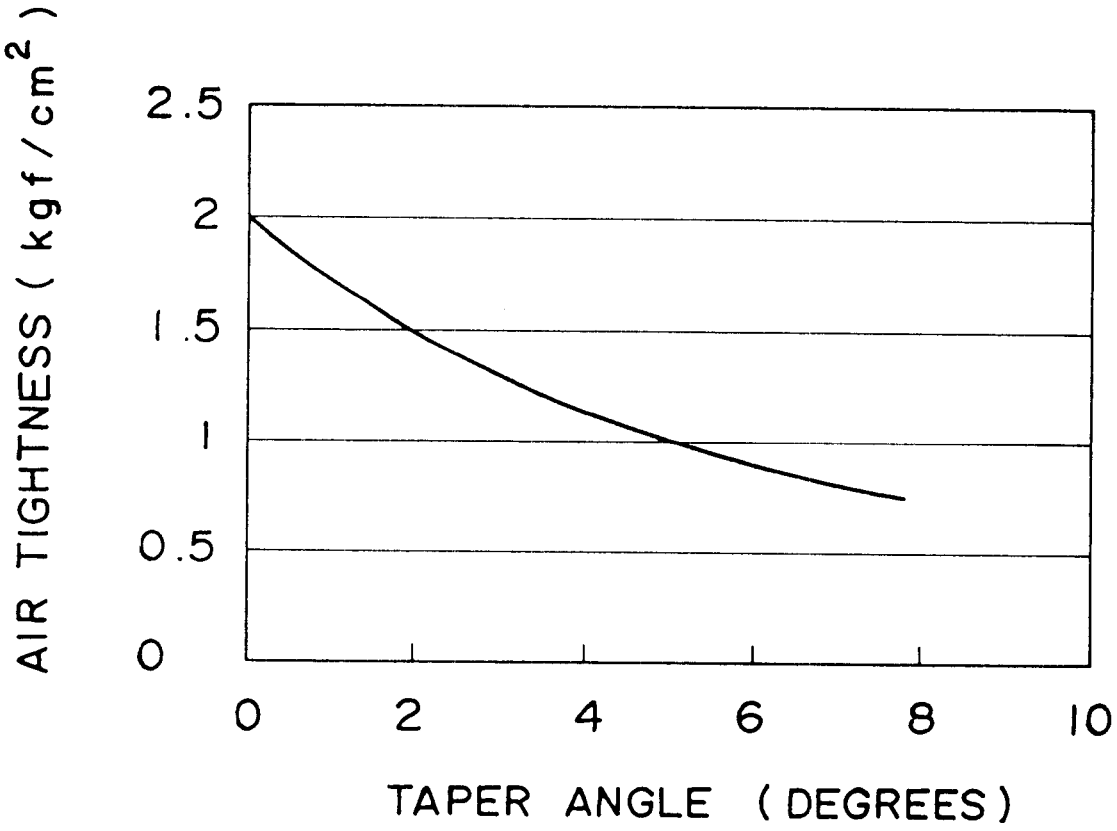
FIG. 8 is a correlative diagram showing changes in air-tightness based on changes in the tapered angles of the tapered face formed on the clamp element of the present invention.

FIG. 8 shows changes in air-tightness of the airtight waterproof slide fastener 10 accompanied by changes in tapered angle $\alpha$ of the tapered face 14*c*. In this tapered angle $\alpha$, the formation start point of the tapered face 14*c* is located at a position whose distance from the outside end face of the connecting portion 16 is determined by summing the thickness D1 of the clamp element 14 and the thickness D2 of the airtight waterproof tape 11. If the formation start point of this tapered face 14*c* is changed, the range of a preferred tapered angle $\alpha$, with which breaking of the airtight waterproof tape 11 does not occur even when fastener is folded, is changed automatically in relation with the contact pressing force between the airtight waterproof tapes 11.

When the tapered angle (clearance angle) $\alpha$ is 0° in FIG. 7, no tapered face 14*c* is formed and the side faces of adjacent clamp elements are in parallel. If the tapered angle $\alpha$ of the tapered face 14*c* is changed from 0° to 8° as shown in FIG. 8, it is understood that air-tightness of the airtight waterproof slide fastener 10 is decreased gradually from 2 to 0.7 kgf/cm$^2$. Therefore, if air-tightness of the airtight waterproof slide fastener 10 is taken into great account, the tapered angle $\alpha$ is preferred to be 5° or less, as indicated by FIG. 8.

However, in addition to improvement of airtight performance, another major object of the present invention is to prevent the airtight waterproof tape 11 from being partly broken when the airtight waterproof slide fastener 10 is bent strongly in the longitudinal direction as described above. Thus, the following experiment was carried out.

Rubber coated fiber fabric tape was employed as the airtight waterproof tape 11, and the coupling element 13 of the engagement tooth 12 was constructed as shown in FIG. 1. The formation start point of the tapered face 14*c* of the nipping portion 15 of the clamp element 14 was located at a dimensional position H whose distance from the outside end face of the connecting portion 16 is determined by summing the thickness D1 of the clamp element 14 and the tape thickness D2 of the airtight waterproof tape 11.

Under this condition, the tapered angle α was set to be 0°, 2°, 5°, and 8°, and the tapered face 14*c* was formed on an entire side face from the dimensional position H to the front end of the nipping portion 15. Ten airtight waterproof slide fasteners 10 were produced thereby. For each fastener 10, averages of stringer bending resistance (tape rapture resistance upon bending), air-tightness (kgf/cm$^2$), overlapping ratio (pressure amount ratio) (%), and chain lateral pulling resistance (kgf/in) of each tapered angle α were calculated. Here, the stringer bending resistance was estimated by folding each airtight waterproof slide fastener 10 300 times and evaluating the degree of rapture with "X," "Δ," "○," and "◎" from the worst to the best.

Table 1 shows the result of the experiment.

TABLE 1

| Tapered angle | 0° | 2° | 5° | 8° |
|---|---|---|---|---|
| Stringer bending resistance | X | Δ | ○ | ◎ |
| Air-tightness | ≧2.0 | About 1.5 | About 1.0 | About 0.7 |
| Overlapping ratio | 100 | 82 | 34 | 12 |
| Chain lateral pulling resistance | 91 | 88 | 84 | 80 |

According to Table 1, the stringer bending resistance rises as the tapered angle α increases, from "Δ" when the taper angle α is 2° to "○" when 5° and "◎" when 8°. On the other hand, the air-tightness decreases as the tapered angle α increases and it can be understood that this occurs depending on the overlapping ratio between opposing front faces of the clamp elements 14. The air-tightness increases as this overlapping ratio increases. Further, it is understood that the chain lateral pulling resistance indicating fallout strength of the engagement tooth 12 when a pair of the fastener stringers 18 are pulled laterally in a separating direction from each other has enough strength to bear sufficiently even if the tapered angle α is 8° if the formation start point of the tapered face 14*c* is set up as described above.

As described above, the tapered angle α is a major factor which greatly affects airtight waterproof performance and durability of the airtight waterproof slide fastener 10, particularly in avoiding a rapture of the airtight waterproof tape 11 when the airtight waterproof slide fastener 10 is folded. Therefore, upon setting the tapered angle α, it is necessary to take into account other factors such as the formation start point of the tapered face 14*c*, chamfered portions 14*d*, 14*e* formed on the inside and outside ridgeline portions of the nipping pieces 15*a*, 15*b*, and setting amount for the arc face R formed on the corner portion at the front end of each of the nipping pieces 15*a*, 15*b*.

For the reasons above, the tapered angle α of the tapered face 14*c* is preferred to be 3° to 70°.

According to the present invention, if, as shown in FIGS. 1 and 4, the chamfered portions 14*d*, 14*e* are formed on the ridgeline portion on the outside ridgeline portion of the opposite side of the tape side and on the tape side of each nipping piece 15*a*, 15*b* of the clamp element 14, when the airtight waterproof slide fastener 10 is folded as described above, slippage occurs between the chamfered portions 14*d* and 14*e* because they are chamfered even if the outside ridgeline portions of the nipping pieces 15*a* of the adjacent clamp elements 14 make a firm contact with each other on the folded side. Consequently, its firm contact point is moved so that the tensile stress generated in the airtight waterproof tape 11 existing between the nipping pieces 15*b*, which are in the opposite side of the folded side, and particularly in the tape portion 11*b* on the connecting portion 16 side of that nipping piece 15*b* is released. In this way, rapture of the tape portion 11*b* is prevented.

Further, as indicated by the sign R in FIG. 1, if the small arc face is formed on the front-end corner portion of each nipping piece 15*a*, 15*b* of the clamp element 14, when the airtight waterproof slide fastener 10 is folded, the nipping pieces 15*a* make a firm contact with each other at the corner portion of each front end side of the adjacent nipping pieces 15*a* at the folded side so as to form a fulcrum point to turn the nipping pieces 15*a*. Thus, the fulcrum point is moved because of the arc face R, so that a part of stress generated in the tape portion 11*b* on the connecting portion 16 side of the nipping pieces 15*b* located opposite to the folded side is released as with the chamfered portions 14*d*, 14*e*. In this way, rapture of the tape portion 11*b* is prevented.

The above description indicates preferred embodiments of the present invention. It is not necessary to provide, for example, the stress-releasing portion formed on the clamp element with all of the tapered face 14*c*, the chamfered portions 14*d*, 14*e* and the arc face R. In some cases, the objective of the present invention can be achieved sufficiently with any one part of the stress-releasing portions or a combination thereof depending on the length or width of the airtight waterproof slide fastener 10, tape material of the airtight waterproof tape 11, size of the clamp element 14, and the like. Therefore, naturally, the present invention is not restricted to the above-described embodiments but may be modified within the scope of respective claims.

What is claimed is:

1. An airtight waterproof slide fastener having a pair of fastener stringers in which a side edge of an airtight waterproof tape wraps and holds a plurality of coupling elements from flange sides, makes their coupling heads project outward, and is folded such that an engagement tooth holding portion having a substantially Ω-shaped cross section is formed on the side edge of the tape and a peripheral face of this engagement tooth holding portion is nipped with a substantially U-shaped clamp element constituted of a nipping portion having a pair of sheet-like nipping pieces and a connecting portion for connecting respective ends of one of the nipping pieces and the other one of the nipping pieces, wherein a stress-releasing portion is formed on the clamp element so as to release tensile stress generated in a tape portion existing between side faces of adjacent nipping pieces when said airtight waterproof tape is folded between adjacent clamp elements.

2. The airtight waterproof slide fastener according to claim 1, wherein opposing front end faces of the nipping portions disposed so as to oppose in a zigzag shape at a predetermined pitch along opposing edge portions of a pair of the fastener stringers when engagement teeth are coupled, are disposed so as to be partly overlapped.

3. The airtight waterproof slide fastener according to claim 1, wherein said stress-releasing portion includes a tapered face in which, in plan view of said clamp element, a width of the side face of said nipping portion decreases gradually at a predetermined angle from a side end face of the connecting portion of the clamp element toward a front end of the nipping portion, with a start position, which is at least on a front end side from a position whose distance from an outside end face of the connecting portion is determined by summing up the thickness of the clamp element and the thickness of the airtight waterproof tape.

4. The airtight waterproof slide fastener according to claim 3, wherein a tapered angle of said tapered faces on both side faces of said clamp element is 3° to 7°.

5. The airtight waterproof slide fastener according to claim 1, wherein said stress-releasing portion includes peripheral face chamfered portions of front-end-side corner portions of said nipping portion.

6. The airtight waterproof slide fastener according to claim 1, wherein said stress-releasing portion includes chamfered portions formed on outside ridgeline portions of said nipping portion.

7. The airtight waterproof slide fastener according to claim 1, wherein said stress-releasing portion includes chamfered portions formed on inside ridgeline portions of said nipping portion.

* * * * *